US008167635B1

(12) United States Patent
Mathews

(10) Patent No.: US 8,167,635 B1
(45) Date of Patent: May 1, 2012

(54) DIELECTRIC SEALING MEMBER AND METHOD OF USE THEREOF

(75) Inventor: Roger D. Mathews, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 16 days.

(21) Appl. No.: 12/906,276

(22) Filed: Oct. 18, 2010

(51) Int. Cl.
*H01R 13/52* (2006.01)

(52) U.S. Cl. ..... 439/277

(58) Field of Classification Search ..... 439/277, 439/578, 585
See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |

(Continued)

FOREIGN PATENT DOCUMENTS

CA 2096710 A1 11/1994

(Continued)

OTHER PUBLICATIONS

U.S. Appl. No. 12/906,243, filed Oct. 18, 2010.

(Continued)

*Primary Examiner* — Phuong Dinh
(74) *Attorney, Agent, or Firm* — Schmeiser Olsen & Watts

(57) ABSTRACT

A connector having a sealing member is provided, wherein the sealing member prevents environmental elements, such as rainwater from entering the connector. Furthermore, a sealing member placed on the inner surface of a post forming a barrier against moisture and other contaminants proximate the second end of the post is also provided.

29 Claims, 16 Drawing Sheets

U.S. PATENT DOCUMENTS

| | | | |
|---|---|---|---|
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann, Jr. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |

4,761,146 A 8/1988 Sohoel
4,772,222 A 9/1988 Laudig et al.
4,789,355 A 12/1988 Lee
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A * 9/1997 Holliday ..... 439/585
5,683,263 A 11/1997 Hse
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,777 A 4/2000 Boyle

| | | | |
|---|---|---|---|
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,261,126 | B1 | 7/2001 | Stirling |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,676,446 | B2 | 1/2004 | Montena |
| 6,683,253 | B1 | 1/2004 | Lee |
| 6,692,285 | B2 | 2/2004 | Islam |
| 6,712,631 | B1 | 3/2004 | Youtsey |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,767,248 | B1 | 7/2004 | Hung |
| 6,786,767 | B1 | 9/2004 | Fuks et al. |
| 6,790,081 | B2 | 9/2004 | Burris et al. |
| 6,805,584 | B1 | 10/2004 | Chen |
| 6,817,896 | B2 | 11/2004 | Derenthal |
| 6,848,939 | B2 | 2/2005 | Stirling |
| 6,848,940 | B2 | 2/2005 | Montena |
| 6,884,113 | B1 | 4/2005 | Montena |
| 6,884,115 | B2 | 4/2005 | Malloy |
| 6,929,508 | B1 | 8/2005 | Holland |
| 6,939,169 | B2 | 9/2005 | Islam et al. |
| 6,971,912 | B2 | 12/2005 | Montena et al. |
| 7,029,326 | B2 | 4/2006 | Montena |
| 7,070,447 | B1 | 7/2006 | Montena |
| 7,086,897 | B2 | 8/2006 | Montena |
| 7,097,499 | B1 | 8/2006 | Purdy |
| 7,102,868 | B2 | 9/2006 | Montena |
| 7,114,990 | B2 | 10/2006 | Bence et al. |
| 7,118,416 | B2 | 10/2006 | Montena et al. |
| 7,125,283 | B1 | 10/2006 | Lin |
| 7,131,868 | B2 | 11/2006 | Montena |
| 7,147,509 | B1 | 12/2006 | Burris et al. |
| 7,156,696 | B1 | 1/2007 | Montena |
| 7,161,785 | B2 | 1/2007 | Chawgo |
| 7,229,303 | B2 | 6/2007 | Vermoesen et al. |
| 7,252,546 | B1 | 8/2007 | Holland |
| 7,255,598 | B2 | 8/2007 | Montena et al. |
| 7,299,550 | B2 | 11/2007 | Montena |
| 7,393,245 | B2 | 7/2008 | Palinkas et al. |
| 7,452,239 | B2 | 11/2008 | Montena |
| 7,476,127 | B1 | 1/2009 | Wei |
| 7,479,035 | B2 | 1/2009 | Bence et al. |
| 7,497,729 | B1 | 3/2009 | Wei |
| 7,507,117 | B2 | 3/2009 | Amidon |
| 7,544,094 | B1 | 6/2009 | Paglia et al. |
| 7,566,236 | B2 | 7/2009 | Malloy et al. |
| 7,607,942 | B1 | 10/2009 | Van Swearingen |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,794,275 | B2 | 9/2010 | Rodrigues |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,833,053 | B2 | 11/2010 | Mathews |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,887,354 | B2 * | 2/2011 | Holliday ..... 439/321 |
| 7,892,005 | B2 | 2/2011 | Haube |
| 7,892,024 | B1 | 2/2011 | Chen |
| 7,927,135 | B1 | 4/2011 | Wlos |
| 7,950,958 | B2 | 5/2011 | Mathews |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2006/0110977 | A1 | 5/2006 | Mathews |
| 2006/0154519 | A1 | 7/2006 | Montena |
| 2007/0026734 | A1 | 2/2007 | Bence et al. |
| 2008/0102696 | A1 | 5/2008 | Montena |
| 2009/0029590 | A1 | 1/2009 | Sykes et al. |
| 2009/0098770 | A1 | 4/2009 | Bence et al. |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0053413 | A1 | 3/2011 | Mathews |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |

| | | | |
|---|---|---|---|
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |

OTHER PUBLICATIONS

Digicon AVL Connector. ARRIS Group Inc. [online]. 3 pages. [retrieved on Apr. 22, 2010]. Retrieved from the Internet<URL: http://www.arrisi.com/special/digiconAVL.asp>.

U.S. Appl. No. 13/018,727, filed Feb. 1, 2011.

* cited by examiner

DIELECTRIC SEALING MEMBER AND METHOD OF USE THEREOF

BACKGROUND

1. Technical Field

This invention relates generally to the field of connectors for coaxial cables. More particularly, this invention provides for a coaxial cable connector comprising at least one sealing member and a method of use thereof.

2. Related Art

Broadband communications have become an increasingly prevalent form of electromagnetic information exchange and coaxial cables are common conduits for transmission of broadband communications. Connectors for coaxial cables are typically connected onto complementary interface ports to electrically integrate coaxial cables to various electronic devices. In addition, connectors are often utilized to connect coaxial cables to various communications modifying equipment such as signal splitters, cable line extenders and cable network modules.

In many instances, these coaxial cables are present outdoors, exposed to weather and/or otherwise exposed to numerous environmental elements. Weathering and various environmental elements can work to create interference problems when metallic components corrode, deteriorate or become galvanically incompatible thereby resulting in intermittent contact and poor electromagnetic shielding.

Accordingly, there is a need in the field of coaxial cable connectors for an improved connector design.

SUMMARY

The following disclosure provides an apparatus for use with coaxial cable connections that offers improved reliability.

A first general aspect of the invention provides a connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising a connector body attached to a post, wherein the post has a first end and a second end, the first end configured to be inserted into an end of the coaxial cable around the foil layer encompassing the dielectric and under the conductive grounding shield thereof, a port coupling element attached to the post, and a sealing member positioned along an inner surface of the post forming a barrier against environmental elements.

A second general aspect of the invention provides a connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising a connector body attached to a post wherein the post has a first end and a second end, the first end configured to be inserted into an end of the coaxial cable around the foil layer encompassing the dielectric and under the conductive grounding shield thereof, a port coupling element attached to the post, and a sealing member positioned between the foil layer and the post, wherein the sealing member prevents environmental elements from entering the connector.

A third general aspect of the invention provides a connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising a connector body, having a first end and a second end, the first end configured to deformably compress against and seal a received coaxial cable, a post, attached to the connector body, a port coupling element, attached to the post, a sealing member located so as to prevent entry of external environmental elements between the post and the foil layer surrounding the dielectric, and a plurality of conductive members, the plurality of conductive members completing a shield preventing ingress of electromagnetic noise into the connector and facilitating grounding of the coaxial cable.

A fourth general aspect of the invention provides a connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising a connector body having a first end and a second end, the first end configured to deformably compress against and seal a received coaxial cable, wherein a post is attached to the connector body, a rotatable coupling element attached to the post, wherein the post has a first end and a second end, and means for sealing the dielectric against ingress of environmental elements without impeding advancing movement of the dielectric and the foil layer through post of the connector.

A fifth general aspect of the invention provides a method for sealing a coaxial cable connector, the method comprising, fixedly attaching a coaxial cable to the coaxial cable connector, the coaxial cable having a center conductor surrounded by a dielectric, the dielectric being surrounded by a foil layer, the foil layer being surrounded by a conductive grounding shield, the conductive grounding shield being surrounded by a protective outer jacket, positioning a sealing member of the coaxial cable connector on a radially inward surface of a post of the connector to block ingress of an environmental element into the connector; and advancing the connector onto an interface port until a surface of the interface port mates with a surface of the sealing member to form part of a seal.

A sixth general aspect of the invention provides a method for sealing a coaxial cable connector that is attachable to a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the method comprising: forming a barrier against ingress of an environmental element, the barrier formed by a sealing member of the coaxial cable connector that is positioned along an inner surface of a post of the connector, wherein the sealing member establishes and maintains physical communication between the inner surface of the post of the connector and the foil layer surrounding the dielectric of the cable, when the cable is attached to the connector.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION

Figure 1:
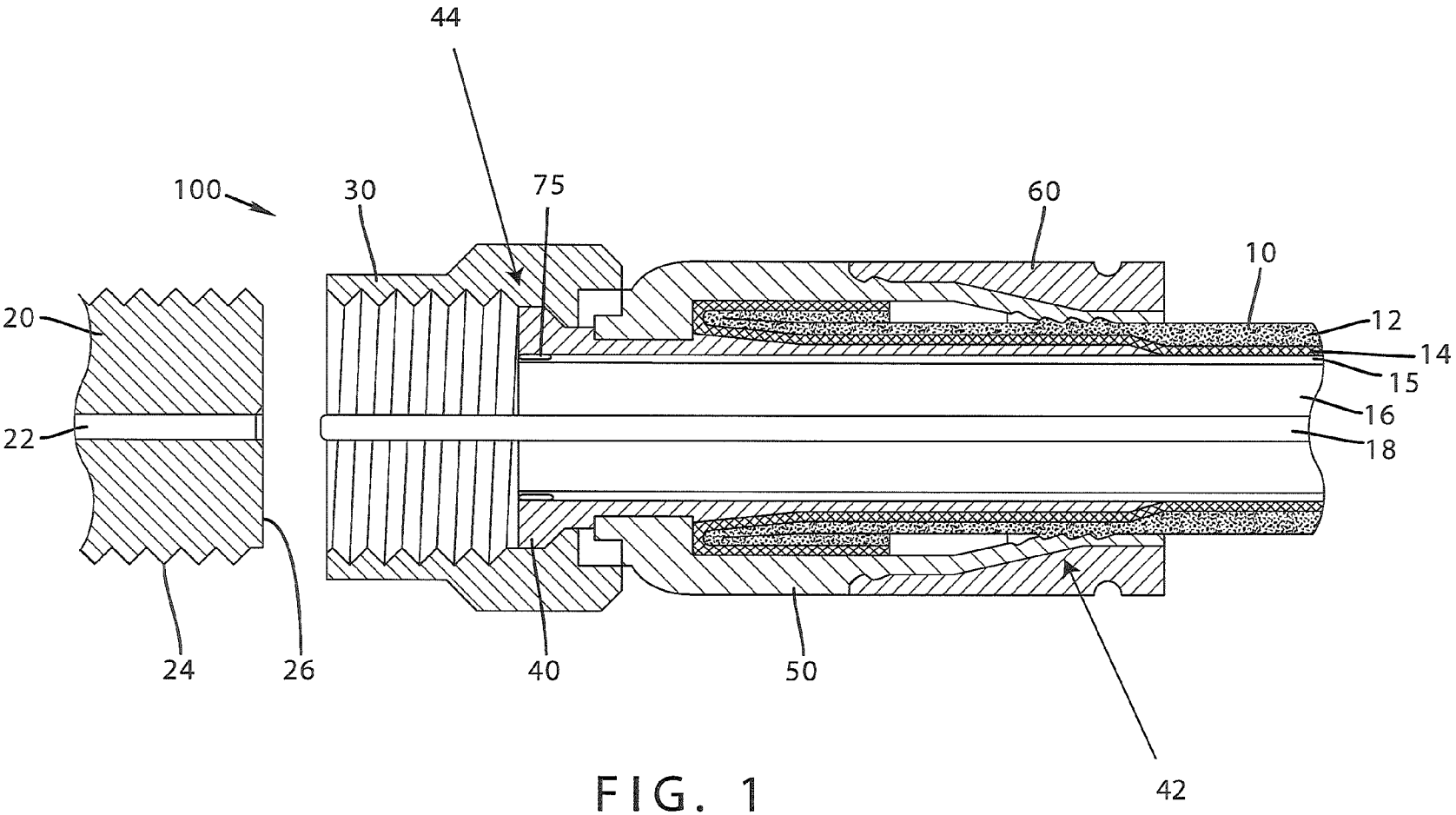
FIG. 1 depicts a sectional side view of an embodiment of a connector, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts one embodiment of a connector 100. The connector 100 may include a coaxial cable 10 having a protective outer jacket 12, a conductive grounding shield 14, a foil layer, an interior dielectric 16, and a center conductor 18. The coaxial cable 10 may be prepared as further embodied in FIG. 1B by removing the protective outer jacket 12 and drawing back the conductive grounding shield 14 to expose a portion of the foil layer 15 encompassing an interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise several conductive strands formed in a continuous braid around the foil layer 15 surrounding the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. Furthermore, there may be more than one grounding shield 14, such as a tri-shield or quad shield cable, and there may also be flooding compounds protecting the shield 14. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, foil layer 15, interior dielectric 16 and/or center conductor 18 may vary based upon generally recognized parameters corresponding to broadband communication standards and/or equipment.

The foil layer 15 may comprise a layer of conductive foil wrapped or otherwise positioned around the dielectric 16, thus the foil layer 15 may surround and/or encompass the dielectric 16. For instance, the foil layer 15 may be positioned between the dielectric 16 and the shield 14. In one embodiment, the foil layer 15 may be bonded to the dielectric 16. In another embodiment, the foil layer 15 may be generally wrapped around the dielectric 16. The foil layer 15 may provide a continuous uniform outer conductor for maintaining the coaxial condition of the coaxial cable 10 along its axial length. The coaxial cable 10 having, inter alia, a foil layer 15 may be manufactured in thousands of feet of lengths. Furthermore, the foil layer 15 may be manufactured to a nominal outside diameter with a plus minus tolerance on the diameter, and may be a wider range than what may normally be achievable with machined, molded, or cast components. The outside diameter of the foil layer 15 may vary in dimension down the length of the cable 10, thus its size may be unpredictable at any point along the cable 10.

Furthermore, preventing environmental elements from contacting the dielectric 16, the foil layer 15, and the inside surface, or radially inward surface, of the post 40 may be important to the longevity and efficiency of the coaxial cable 10. Environmental elements may include any environmental pollutant, any contaminant, chemical compound, rainwater, moisture, condensation, stormwater, polychlorinated biphenyl's (PCBs), contaminated soil from runoff, pesticides, herbicides, and the like. Environmental elements, such as water or moisture, may enter the connector 100 when the connector is loosely connected to an interface port 20. Moreover, environmental contaminants may enter connector components via numerous potential means whenever the coaxial cable 10 and connector 100 are exposed to environmental elements. One path environmental elements may enter the connector 100 and come into contact with the dielectric 16 or foil layer 15 may be through the threaded nut 30. For example, water, or any environmental element may enter the area within the threaded nut 30 and continue towards the second end 44 of the post 40, and may seep through small openings between components of the connector to contact the dielectric 16, foil layer 15, and/or the inside surface of the post 40 causing undesirable results and damage. A seal or a barrier may prevent environmental elements from entering the connector 100 and ultimately the dielectric 16, the foil layer 15, and/or the inside surface of the post 40 and may be formed by placing a sealing member 75 on the inner (radially inward) surface of the post 40 proximate the second end 44, thereby preventing environmental elements from entering the connector 100, at that location.

Referring further to FIG. 1, the connector 100 may also include a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and height of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

With continued reference to FIG. 1, an embodiment of the connector 100 may further comprise a threaded nut 30, a post 40, a connector body 50, a fastener member 60, and a sealing member 75. The sealing member 75 may be formed of a rubber polymer. Additional materials the sealing member may be formed of may include, but are not limited to conductive polymers, plastics, conductive elastomers, elastomeric mixtures, composite materials having conductive properties, conductive rubber, and/or the like and/or any operable combination thereof. The sealing member 75 may be a resilient, rigid, semi-rigid, flexible, or elastic, and may have a circular, rectangular, square, or any appropriate geometrical cross-section forming a ring-shaped member. For example, the sealing member 75 may comprise a substantially circinate torus or toroid structure, or other ring-like structure. The sealing member 75 may be placed inside or along an inner surface of the post 40 to form, create, erect, build, provide, etc. a barrier against environmental elements, thereby preventing environmental elements from entering the connector 100. This may be true for all cases of tolerance of the cable 10 as well as the inside of the post 40. In one embodiment, the sealing member 75 may be press-fit onto the inner surface of the post 40, proximate the second end 44 of the post 40, such that the diameter of the sealing member 75 may be slightly smaller than the diameter of the second end 44 of the post 40. For example, the sealing member 75 may be press-fit, attached, fastened, fixed, adhered, and/or coupled to the inner wall of the post 40 proximate the second end 44, such that the sealing member 75 fits snugly when placed proximate the second end 44 of the post 40. In another non-limiting example, the sealing member 75 may be positioned on inner surface of the post 40 at the edge of the second end 44, as depicted in FIG. 1. The location of the sealing member 75 may prevent external environmental elements such as moisture and rainwater from entering the connector 100, but does not impede the movement of the dielectric 16 (surrounded by a foil layer 15) within the post 40, specifically towards the second end 44 of the post 40. In another embodiment, the sealing member may be positioned proximate the first end 42 of the post. In yet another embodiment, the sealing member 75 may be placed along an inner surface of the post 40 at any point between the first end 42 and the second 44. Moreover, more than one sealing member 75 may be placed along the inner surface of the post 40 to embolden the seal/barrier created to prevent external environmental elements from entering the connector 100 at that specific location. Those skilled in the art would appreciate that the sealing member 75 may be fabricated by extruding, coating, molding, injecting, cutting, turning, elastomeric batch processing, vulcanizing, mixing, stamping, casting, and/or the like and/or any combination thereof in order to provide efficient production of the component.

The sealing member 75 may be in physical communication or contact with the foil layer 15, which may prevent environmental elements from entering a connector 100, such as an F connector. For example, when the dielectric 16 and center conductor 18 are proximate the second end 44 of the post 40, the foil layer 15 contacts the sealing member 75. If a sealing member is placed proximate the first end 42 or somewhere between the first end 42 and the second 44, the foil layer 15 may also contact the sealing member 75 at that location. The physical contact may be sufficient and adequate because the coaxial cable 10 may be radially compressed proximate the second end 44 of the post, thereby strengthening or tightening the contact between the foil layer 15 and the sealing member 75, as well as strengthening or tightening the physical contact between the post 40 and the sealing member 75. In some embodiments, the physical contact may be strengthened because a radial compressive force applied to the coaxial cable 10 may cause the post 40 to apply or exert a force onto the dielectric 16. The sealing member 75 and foil layer 15 positioned between the post 40 and the dielectric 16 may be compressed together, thereby strengthening the physical contact between them, which may ensure an adequate and continuous physical contact or communication between them. However, adequate and continuous contact may be established and maintained by the placement of a sealing member 75 on the inner surface of the post 40 without the need to radially compress the connector 100. The physical communication or contact between the foil layer 15 and the sealing member 75, and between the post 40 and the sealing member 75 may create a seal or barrier against external environmental elements, such as moisture. For example, the adequate and continuous contact may keep environmental elements external to the connector 100, and/or post 40, dielectric 16, foil layer 15, center conductor 18, and shield 14.

Figure 1A:
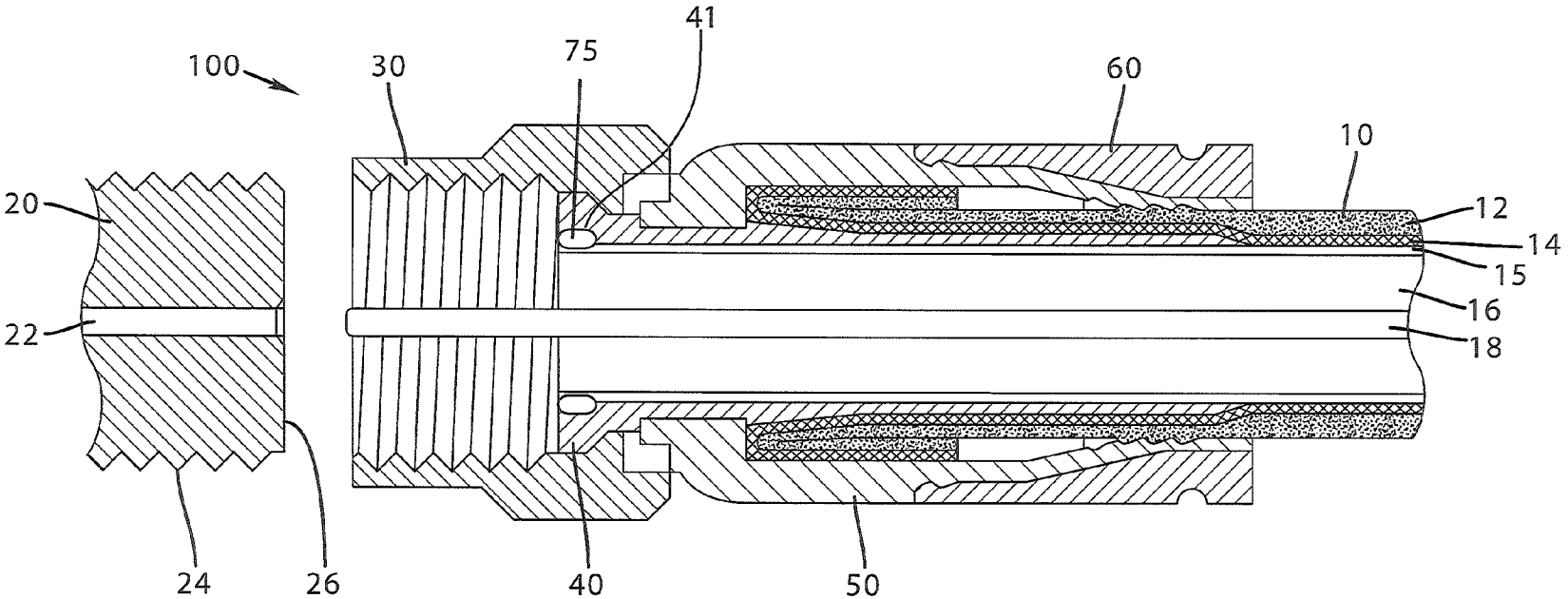
FIG. 1A depicts a sectional side view of an embodiment of a connector having a post notch, in accordance with the present invention.
Figure 1B:
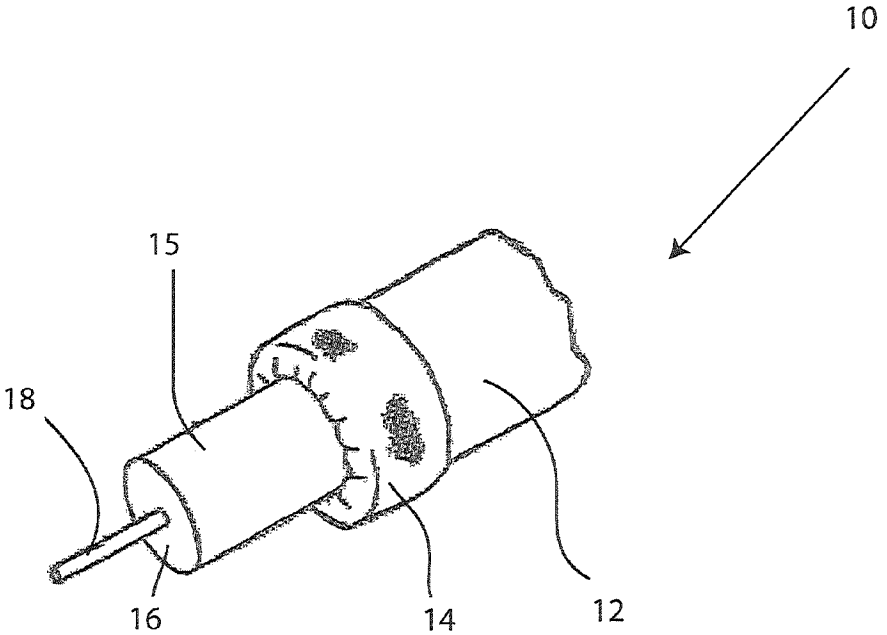
FIG. 1B depicts a perspective view of an embodiment of a prepared coaxial cable, in accordance with the present invention.

FIG. 1A depicts an embodiment of the connector 100 which may comprise a threaded nut 30, a post 40 having a post notch 41, a connector body 50, a fastener member 60, and a sealing member 75 fitting within the post notch 41. The sealing member 75 may be a resilient, rigid, semi-rigid, flexible, or elastic, and may have a circular, rectangular, square, or any appropriate geometrically dimensioned cross-section forming a ring-shaped member. For example, the sealing member 75 may comprise a substantially circinate torus or toroid structure, or other ring-like structure. The sealing member 75 may be placed inside or along an inner surface of the post 40 to ensure continuous physical contact around the foil layer 15 in all cases of tolerance of the cable 10 as well as the inside of the post 40. However, instead of being press-fit within the inner surface of the post 40, all or a portion of the sealing member 75 may reside in the post notch 41. For example, a portion, or a first surface, of the sealing member 75 may reside within the post notch 41, while the other portion, or second surface, may maintain direct and continuous contact with the foil layer 15 providing a barrier against external environmental elements from entering the connector 100. Additionally, a post 40 may have more than one post notch 41, each post notch 41 accommodating a sealing member 75. Thus, there may be multiple sealing members 75 present in an operable connector 100.

Figure 2:
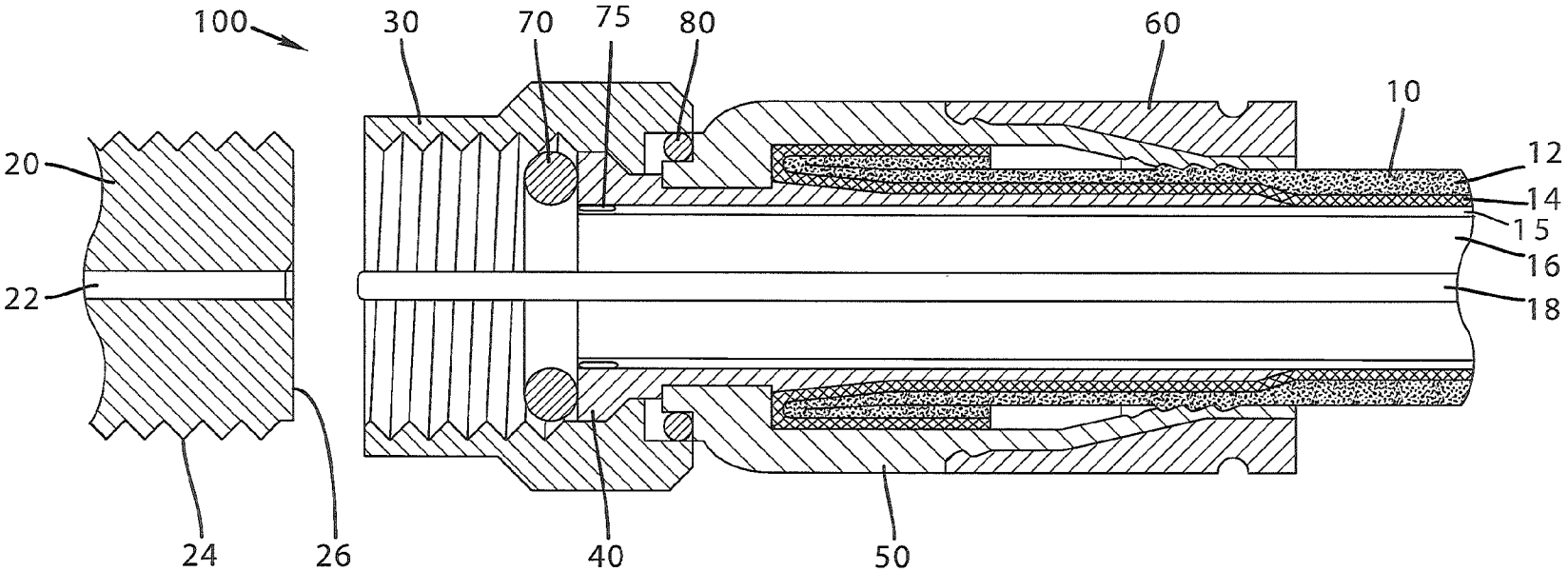
FIG. 2 depicts a sectional side view of an embodiment of a connector having a sealing member, and at least two conductive members, in accordance with the present invention.
Figure 2A:
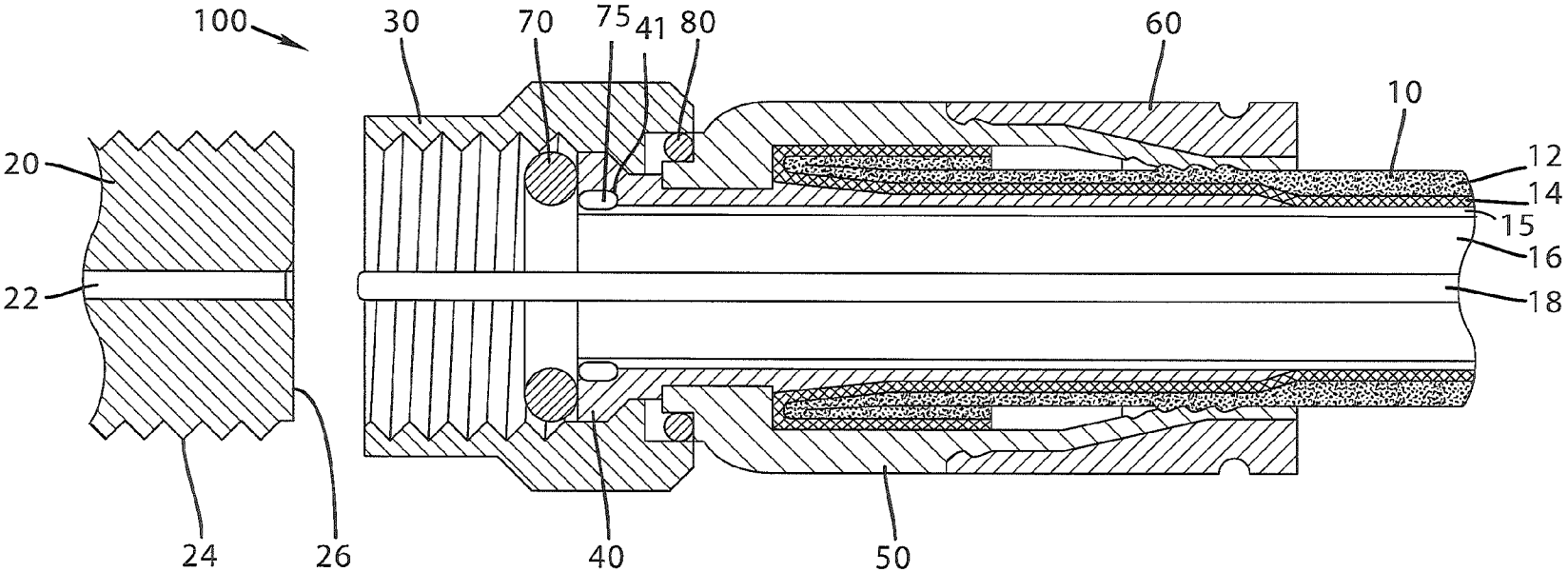
FIG. 2A depicts a sectional side view of an embodiment of a connector with a post notch, having a sealing member, and at least two conductive members, in accordance with the present invention.

FIG. 2 depicts an embodiment of the connector 100 which may further comprise a threaded nut 30, a post 40, a connector body 50, a fastener member 60, a sealing member 75, a mating edge conductive member such as O-ring 70, and/or a connector body conductive member, such as O-ring 80, and means for conductively sealing and electrically coupling the connector body 50 and threaded nut 30. The means for conductively sealing and electrically coupling the connector body 50 and threaded nut 30 may be the employment of the connector body conductive member 80 positioned in a location so as to make a physical seal and effectuate electrical contact between the connector body 50 and threaded nut 30. The sealing member 75 may be press-fit within the inside of the post 40 or may reside in the post notch 41 as shown in FIG. 2A.

Figure 3:
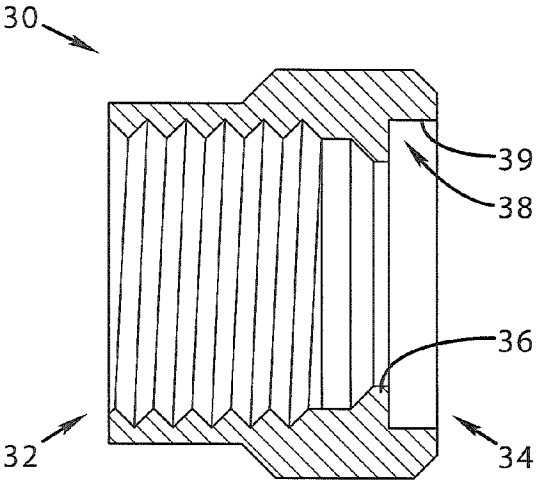
FIG. 3 depicts a sectional side view of an embodiment of a threaded nut, in accordance with the present invention.

With additional reference to the drawings, FIG. 3 depicts a sectional side view of an embodiment of a threaded nut 30, or port coupling element, having a first end 32 and opposing second end 34. The threaded nut 30 may be rotatably secured to the post 40 to allow for rotational movement about the post 40. The threaded nut 30 may comprise an internal lip 36 located proximate the second end 34 and configured to hinder axial movement of the post 40 (shown in FIG. 4). Furthermore, the threaded nut 30 may comprise a cavity 38 extending axially from the edge of second end 34 and partial defined and bounded by the internal lip 36. The cavity 38 may also be partially defined and bounded by an outer internal wall 39. The threaded nut 30 may be formed of conductive materials facilitating grounding through the nut. Accordingly the nut 30 may be configured to extend an electromagnetic buffer by electrically contacting conductive surfaces of an interface port 20 when a connector 100 (shown in FIG. 1) is advanced onto the port 20. In addition, the threaded nut 30 may be formed of non-conductive material and function only to physically secure and advance a connector 100 onto an interface port 20. Moreover, the threaded nut 30 may be formed of both conductive and non-conductive materials. For example the internal lip 36 may be formed of a polymer, while the remainder of the nut 30 may be comprised of a metal or other conductive material. In addition, the threaded nut 30 may be formed of metals or polymers or other materials that would facilitate a rigidly formed body. Manufacture of the threaded nut 30 may include casting, extruding, cutting, turning, tapping, drilling, injection molding, blow molding, or other fabrication methods that may provide efficient production of the component. Those in the art should appreciate the various of embodiments of the nut 30 may also comprise a coupler member, or coupling element, having no threads, but being dimensioned for operable connection to a corresponding interface port, such as interface port 20.

Figure 4:
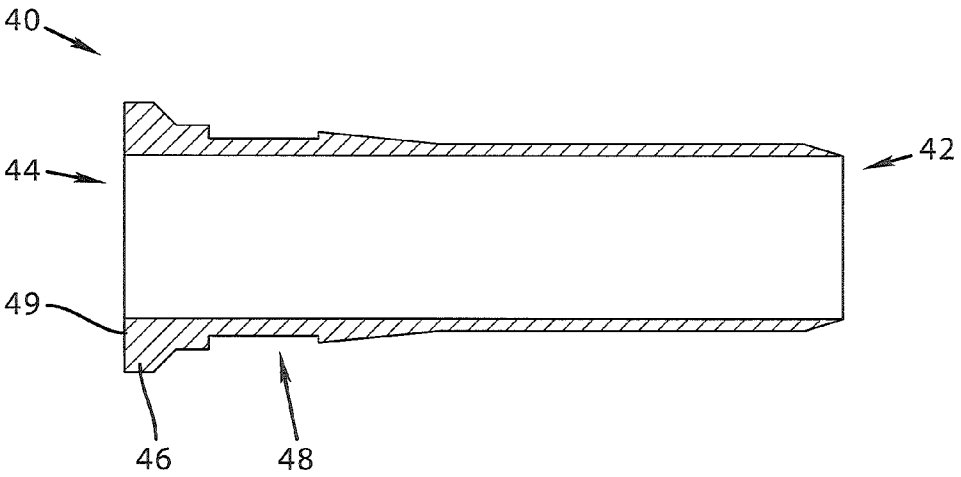
FIG. 4 depicts a sectional side view of an embodiment of a post, in accordance with the present invention.

With further reference to the drawings, FIG. 4 depicts a sectional side view of an embodiment of a post 40 in accordance with the present invention. The post 40 may comprise a first end 42 and opposing second end 44. Furthermore, the post 40 may comprise a flange 46 configured to contact internal lip 36 of threaded nut 30 (shown in FIG. 2) thereby facilitating the prevention of axial movement of the post beyond the contacted internal lip 36. Further still, an embodiment of the post 40 may include a surface feature 48 such as a shallow recess, detent, cut, slot, or trough. Additionally, the post 40 may include a mating edge 49. The mating edge 49 may be configured to make physical and/or electrical contact with an interface port 20 or mating edge member (shown in FIG. 1) or O-ring 70 (shown in FIG. 8). The post 40 should be formed such that portions of a prepared coaxial cable 10 including the dielectric 16, foil layer 15, and center conductor 18 (shown in FIG. 1) may pass axially into the first end 42 and/or through the body of the post 40. Moreover, the post 40 should be dimensioned such that the post 40 may be inserted into an end of the prepared coaxial cable 10, around the foil layer surrounding the dielectric 16, and under the protective outer jacket 12 and conductive grounding shield 14. Accordingly, where an embodiment of the post 40 may be inserted into an end of the prepared coaxial cable 10 under the drawn back conductive grounding shield 14 substantial physical and/or electrical contact with the shield 14 may be accomplished thereby facilitating grounding through the post 40. The post 40 may be formed of metals or other conductive materials that would facilitate a rigidly formed body. In addition, the post 40 may also be formed of non-conductive materials such as polymers or composites that facilitate a rigidly formed body. In further addition, the post may be formed of a combination of both conductive and non-conductive materials. For example, a metal coating or layer may be applied to a polymer of other non-conductive material. Manufacture of the post 40 may include casting, extruding, cutting, turning, drilling, injection molding, spraying, blow molding, or other fabrication methods that may provide efficient production of the component.

Figure 4A:
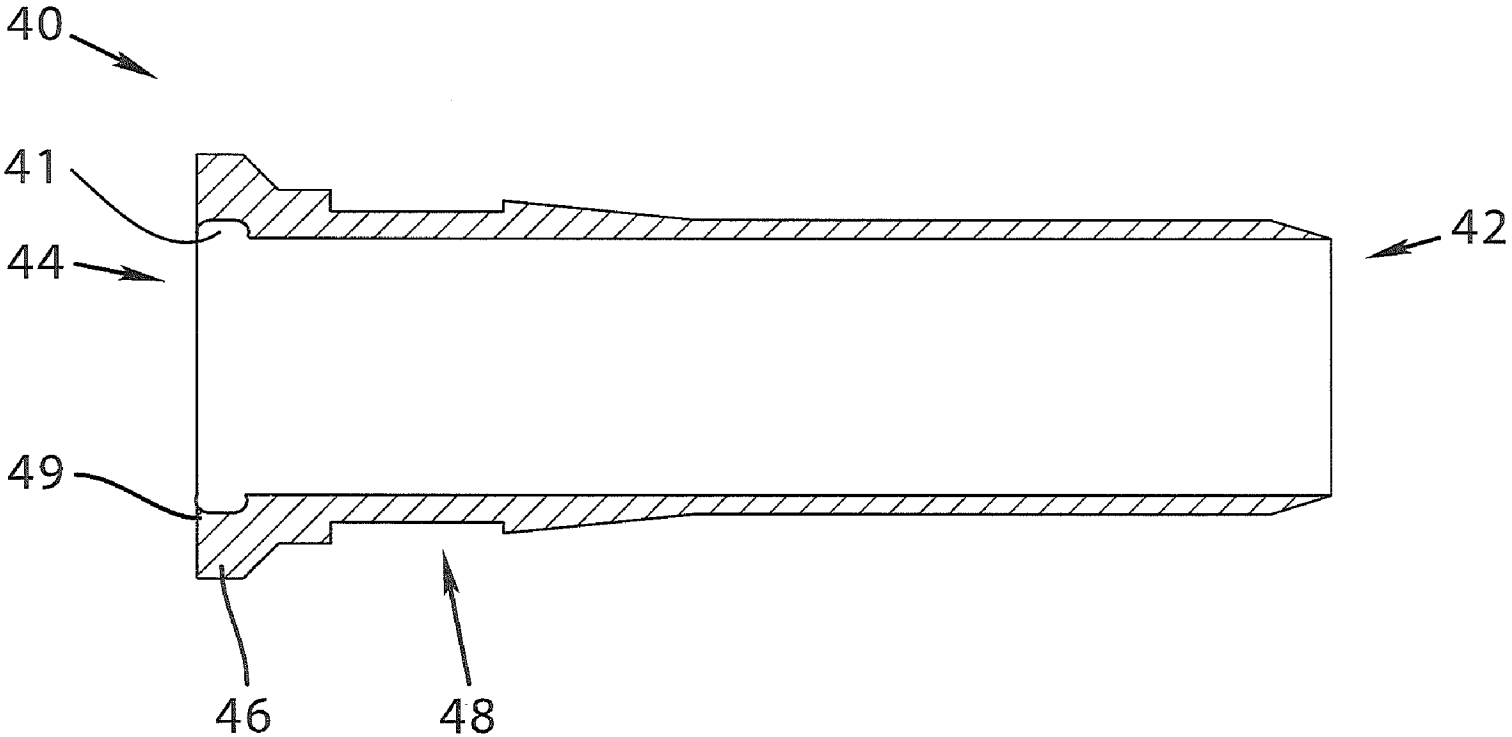
FIG. 4A depicts a sectional side view of an embodiment of a post having a post notch, in accordance with the present invention.

FIG. 4A depicts an embodiment of post 40 having a first end 42 and a second end 44, and a post notch 41 proximate the second end 44. The post notch 41 may be a notch, opening, indent, trough, recess, detent, or slot that may accommodate a portion of the sealing member 75. The post notch 41 may be curvilinear to accommodate a curvilinear sealing member 75 or the post notch 41 may form 90° angles to accommodate a sealing member 75 having a square or rectangular cross-section. The post notch 41 may extend 360° around the inside of the post 40. For example, a portion, or first surface, of the sealing member 75 in the shape of an O-ring may fit within in the post notch 41, while the other portion, or second surface, maintains direct physical contact with and around the foil layer 15.

Figure 5:
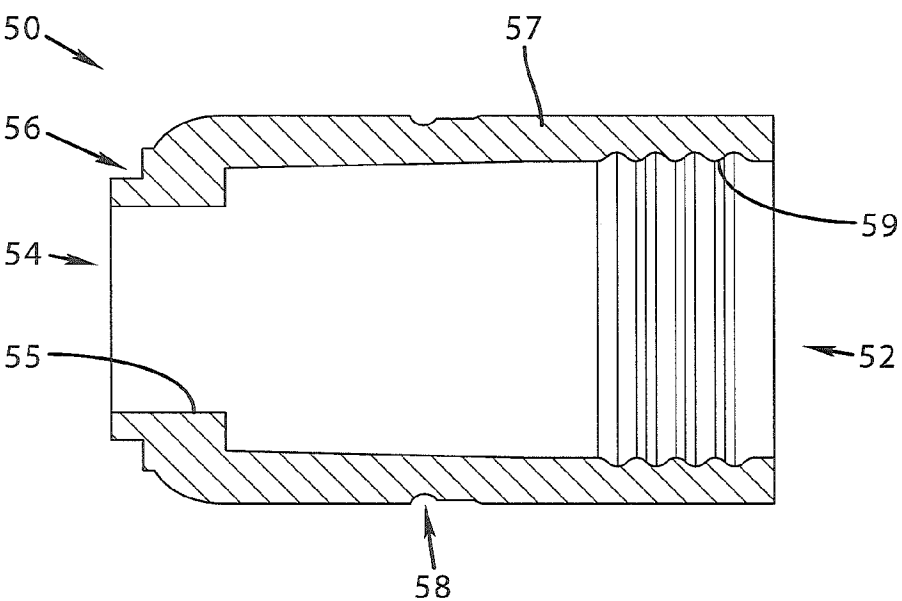
FIG. 5 depicts a sectional side view of an embodiment of a connector body, in accordance with the present invention.

With continued reference to the drawings, FIG. 5 depicts a sectional side view of a connector body 50. The connector body 50 may comprise a first end 52 and opposing second end 54. Moreover, the connector body may include an internal annular lip 55 configured to mate and achieve purchase with the surface feature 48 of post 40 (shown in FIG. 4). In addition, the connector body 50 may include an outer annular recess 56 located proximate the second end 54. Furthermore, the connector body may include a semi-rigid, yet compliant outer surface 57, wherein the outer surface 57 may include an annular detent 58. The outer surface 57 may be configured to form an annular seal when the first end 52 is deformably compressed against a received coaxial cable 10 by a fastener member 60 (shown in FIG. 1). Further still, the connector body 50 may include internal surface features 59, such as annular serrations formed proximate the first end 52 of the connector body 50 and configured to enhance frictional restraint and gripping of an inserted and received coaxial cable 10. The connector body 50 may be formed of materials such as, polymers, bendable metals or composite materials that facilitate a semi-rigid, yet compliant surface 57. Further, the connector body 50 may be formed of conductive or non-conductive materials or a combination thereof. Manufacture of the connector body 50 may include casting, extruding, cutting, turning, drilling, injection molding, spraying, blow molding, or other fabrication methods that may provide efficient production of the component.

Figure 6:
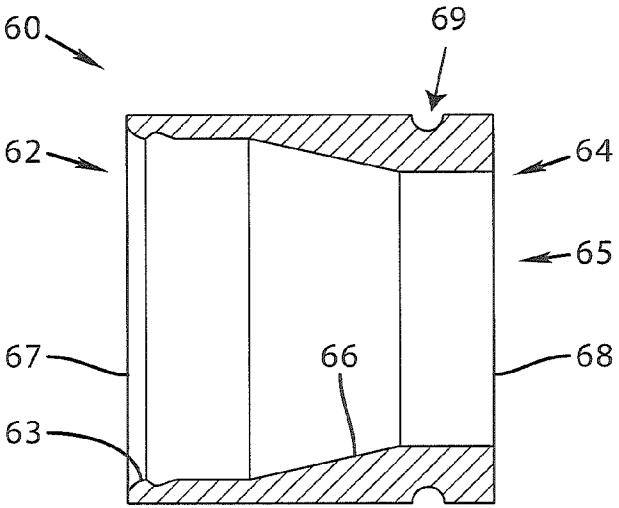
FIG. 6 depicts a sectional side view of an embodiment of a fastener member, in accordance with the present invention.

Referring further to the drawings, FIG. 6 depicts a sectional side view of an embodiment of a fastener member 60 in accordance with the present invention. The fastener member 60 may have a first end 62 and opposing second end 64. In addition, the fastener member 60 may include an internal annular protrusion 63 located proximate the first end 62 of the fastener member 60 and configured to mate and achieve purchase with the annular detent 58 on the outer surface 57 of connector body 50 (shown in FIG. 5). Moreover, the fastener member 60 may comprise a central passageway 65 defined between the first end 62 and second end 64 and extending axially through the fastener member 60. The central passageway 65 may comprise a ramped surface 66 which may be positioned between a first opening or inner bore 67 having a first diameter positioned proximate with the first end 62 of the fastener member 60 and a second opening or inner bore 68 having a second diameter positioned proximate with the second end 64 of the fastener member 60. The ramped surface 66 may act to deformably compress the inner surface 57 of a connector body 50 when the fastener member 60 is operated to secure a coaxial cable 10 (shown in FIG. 1). Additionally, the fastener member 60 may comprise an exterior surface feature 69 positioned proximate with the second end 64 of the fastener member 60. The surface feature 69 may facilitate gripping of the fastener member 60 during operation of the connector 100 (see FIG. 1). Although the surface feature 69 is shown as an annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, polymers, composites and the like. Furthermore, the fastener member 60 may be manufactured via casting, extruding, cutting, turning, drilling, injection molding, spraying, blow molding, or other fabrication methods that may provide efficient production of the component.

Figure 7:
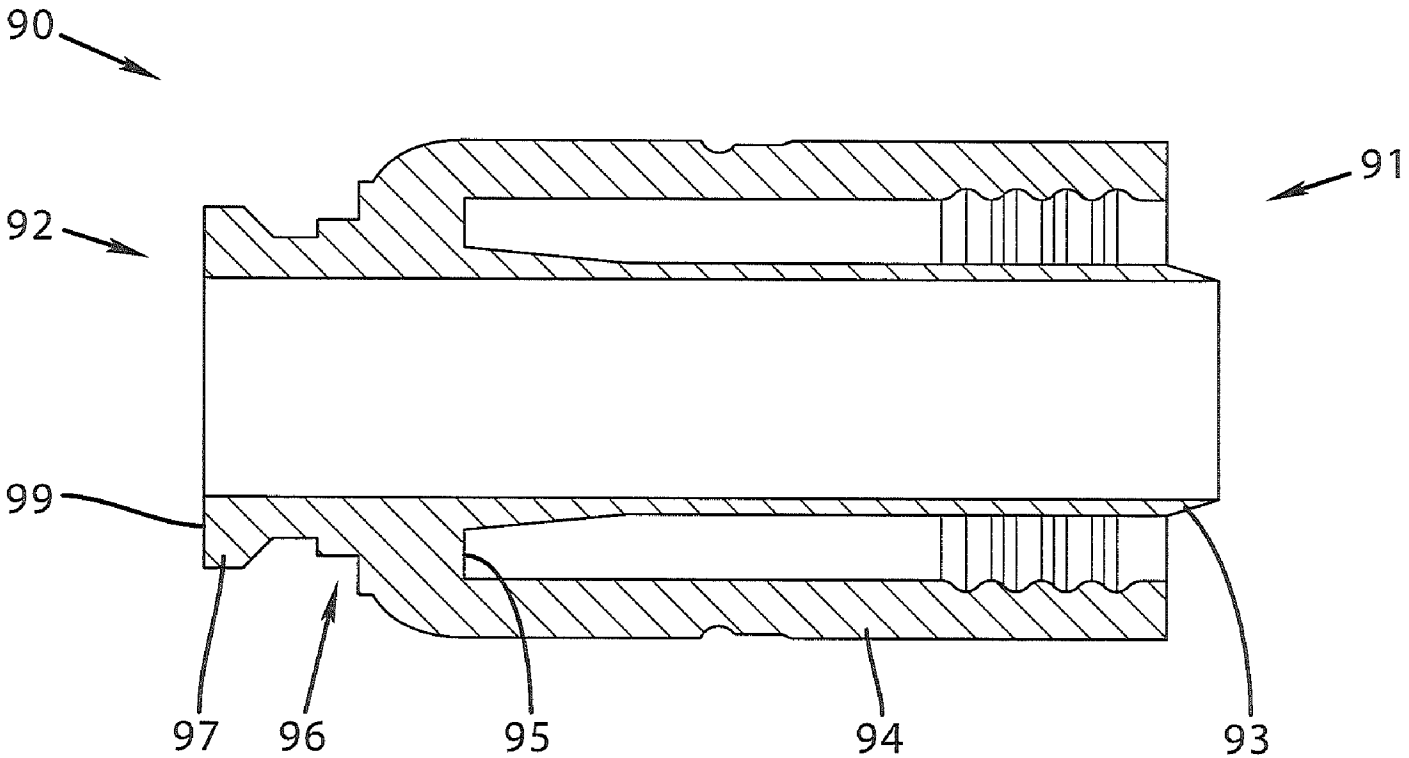
FIG. 7 depicts a sectional side view of an embodiment of a connector body having an integral post, in accordance with the present invention.

Referring still further to the drawings, FIG. 7 depicts a sectional side view of an embodiment of an integral post connector body 90 in accordance with the present invention. The integral post connector body 90 may have a first end 91 and opposing second end 92. The integral post connector body 90 physically and functionally integrates post and connector body components of an embodied connector 100 (shown in FIG. 1). Accordingly, the integral post connector body 90 includes a post member 93. The post member 93 may render connector operability similar to the functionality of post 40 (shown in FIG. 4). For example, the post member 93 of integral post connector body 90 may include a mating edge 99 configured to make physical and/or electrical contact with an interface port 20 or mating edge member or O-ring 70 (shown in FIG. 1). The post member 93 of integral should be formed such that portions of a prepared coaxial cable 10 including the dielectric 16, foil layer 15, and center conductor 18 (shown in FIG. 1) may pass axially into the first end 91 and/or through the post member 93. Moreover, the post member 93 should be dimensioned such that a portion of the post member 93 may be inserted into an end of the prepared coaxial cable 10, around the dielectric 16 and foil layer 15, and under the protective outer jacket 12 and conductive grounding shield 14. Further, the integral post connector body 90 includes a connector body surface 94. The connector body surface 94 may render connector 100 operability similar to the functionality of connector body 50 (shown in FIG. 5). Hence, connector body surface 94 should be semi-rigid, yet compliant. The inner connector body surface 94 may be configured to form an annular seal when compressed against a coaxial cable 10 by a fastener member 60 (shown in FIG. 1). In addition, the integral post connector body 90 may include an interior wall 95. The interior wall 95 may be configured as an unbroken surface between the post member 93 and outer connector body surface 94 of integral post connector body 90 and may provide additional contact points for a conductive grounding shield 14 of a coaxial cable 10. Furthermore, the integral post connector body 90 may include an outer recess formed proximate the second end 92. Further still, the integral post connector body 90 may comprise a flange 97 located proximate the second end 92 and configured to contact internal lip 36 of threaded nut 30 (shown in FIG. 3) thereby facilitating the prevention of axial movement of the integral post connector body 90 with respect to the threaded nut 30, yet still allowing rotational movement of the axially secured nut 30. The integral post connector body 90 may be formed of materials such as, polymers, bendable metals or composite materials that facilitate a semi-rigid, yet compliant outer connector body surface 94. Additionally, the integral post connector body 90 may be formed of conductive or non-conductive materials or a combination thereof. Manufacture of the integral post connector body 90 may include casting, extruding, cutting, turning, drilling, injection molding, spraying, blow molding, or other fabrication methods that may provide efficient production of the component.

Figure 7A:
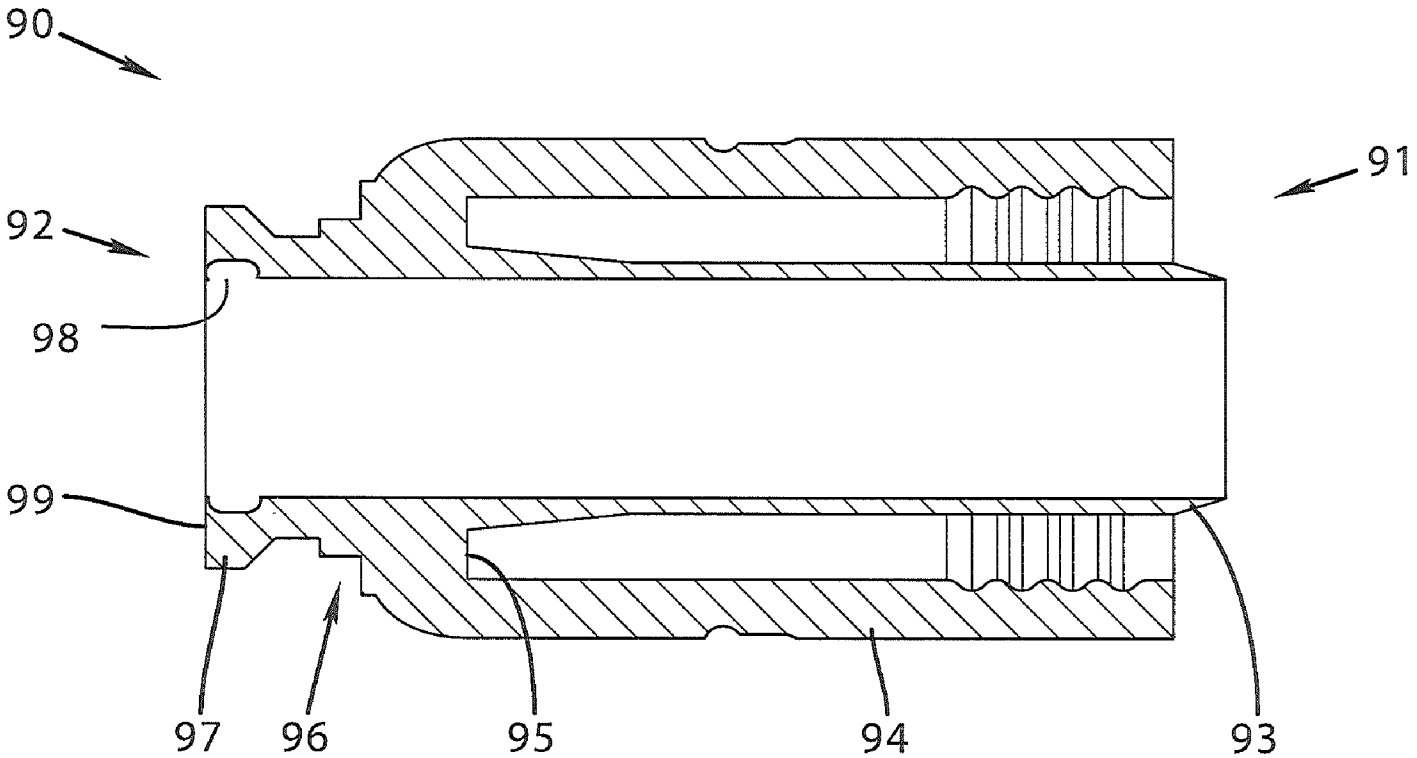
FIG. 7A depicts a sectional side view of an embodiment of a connector body having an integral post, the integral post including a post notch, in accordance with the present invention.

FIG. 7A depicts an embodiment of integral post connector body 90 having a first end 91 and a second end 92, and an integral post notch 98 proximate the second end 92. The integral post notch 98 may be a notch, opening, indent, recess, detent, trough, or slot that may accommodate a portion of the sealing member 75. The integral post notch 98 may be curvilinear to accommodate a curvilinear sealing member 75 or the integral post notch 98 may form 90° angles to accommodate a square or rectangular sealing member 75. The integral post notch 98 may extend 360° around the inside of the integral post connector body 90. For example, a portion, or first surface, of the sealing member 75 in the shape of an O-ring may fit within in the integral post notch 98, while the other portion, or second surface, maintains direct contact with the foil layer 15. Additionally, an integral post connector body 90 may have more than one integral post notch 98, each integral post notch 98 accommodating a sealing member 75. Thus, there may be multiple sealing members 75 present in an operable connector 100.

Figure 8:
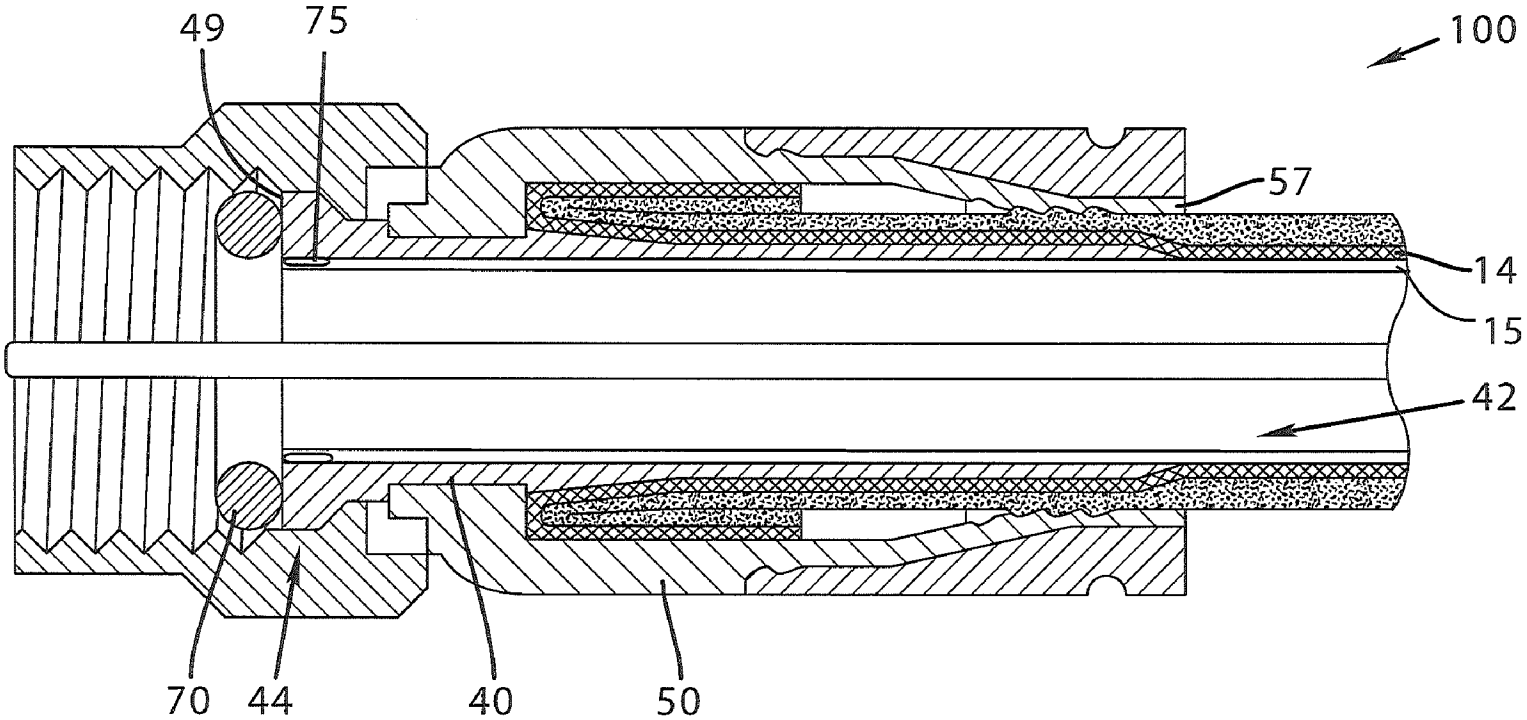
FIG. 8 depicts a sectional side view of an embodiment of a connector configured with a sealing member and at least one conductive member proximate a second end of a post, in accordance with the present invention.

With continued reference to the drawings, FIG. 8 depicts a sectional side view of an embodiment of a connector 100 configured with a mating edge conductive member 70 proximate a second end 44 of a post 40, and a sealing member 75 located proximate a second end 44 of the post 40. The mating edge conductive member 70 should be formed of a conductive material. Such materials may include, but are not limited to conductive polymers, plastics, conductive elastomers, elastomeric mixtures, composite materials having conductive properties, soft metals, conductive rubber, and/or the like and/or any workable combination thereof. The mating edge conductive member 70 may comprise a substantially circinate torus or toroid structure adapted to fit within the internal threaded portion of threaded nut 30 such that the mating edge conductive member 70 may make contact with and/or reside continuous with a mating edge 49 of a post 40 when attached to post 40 of connector 100. For example, one embodiment of the mating edge conductive member 70 may be an O-ring. The mating edge conductive member 70 may facilitate an annular seal between the threaded nut 30 and post 40 thereby providing a physical barrier to unwanted ingress of moisture and/or other environmental contaminates. Moreover, the mating edge conductive member 70 may facilitate electrical coupling of the post 40 and threaded nut 30 by extending therebetween an unbroken electrical circuit. In addition, the mating edge conductive member 70 may facilitate grounding of the connector 100, and attached coaxial cable (shown in FIG. 1), by extending the electrical connection between the post 40 and the threaded nut 30. Furthermore, the mating edge conductive member 70 may effectuate a buffer preventing ingress of electromagnetic noise between the threaded nut 30 and the post 40. The mating edge conductive member or O-ring 70 may be provided to users in an assembled position proximate the second end 44 of post 40, or users may themselves insert the mating edge conductive O-ring 70 into position prior to installation on an interface port 20 (shown in FIG. 1). Those skilled in the art would appreciate that the mating edge conductive member 70 may be fabricated by extruding, coating, molding, injecting, cutting, turning, elastomeric batch processing, vulcanizing, mixing, stamping, casting, and/or the like and/or any combination thereof in order to provide efficient production of the component.

Figure 8A:
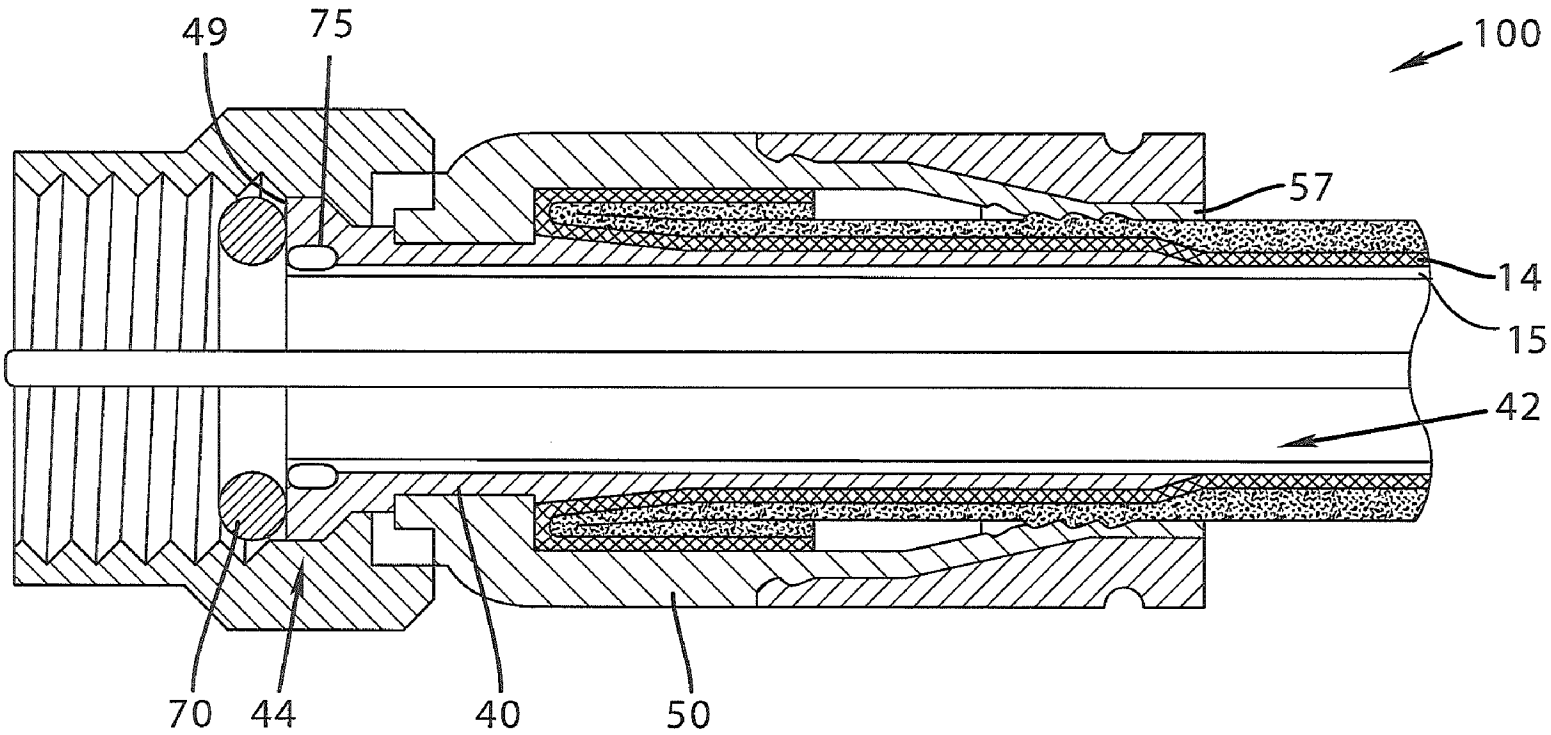
FIG. 8A depicts a sectional side view of an embodiment of a connector configured with a sealing member and at least one conductive member proximate a second end of a post having a post notch, in accordance with the present invention.

FIG. 8A depicts a sectional side view of an embodiment of a connector 100 configured with a mating edge conductive member 70 proximate a second end 44 of a post 40, and a sealing member 75 located proximate a second end 44 of the post 40, wherein a portion of the sealing member 75 resides in a post notch 41, in accordance with the present invention. The post notch 41 may be a notch, opening, recess, detent, indent, trough, or slot that may accommodate a portion of the sealing member 75. The post notch 41 may be curvilinear to accommodate a curvilinear sealing member 75 or the post notch 41 may form 90° angles to accommodate a square or rectangular sealing member 75. The post notch 41 may extend 360° around the inside of the post 40. For example, a portion of the sealing member 75 in the shape of an O-ring may fit within in the post notch 41, while the other portion maintains direct contact with the foil layer 15 providing a barrier against external environmental elements from entering a connector 100. Additionally, there may be multiple post notches 41 corresponding to multiple sealing members 75 as described supra.

Figure 9:
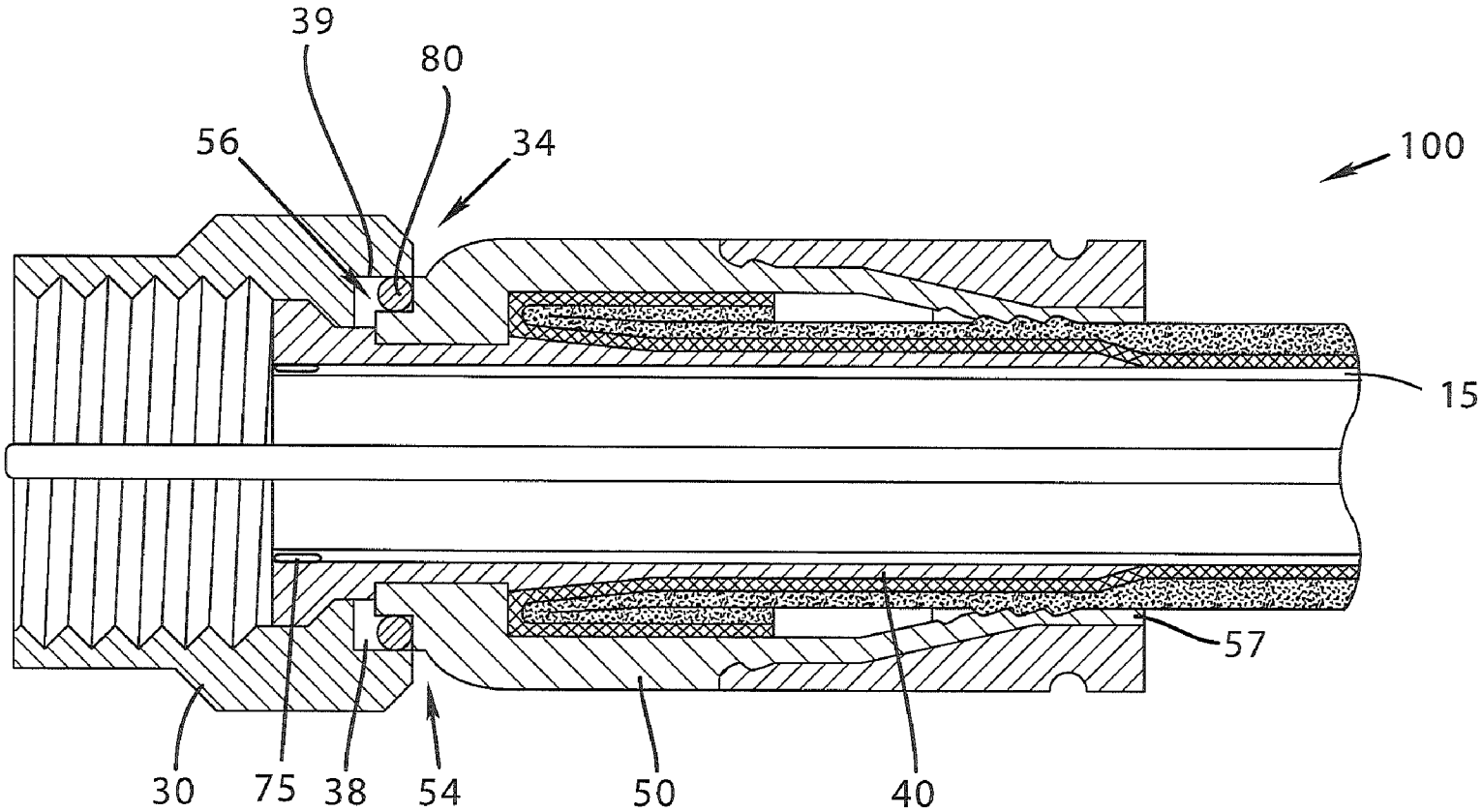
FIG. 9 depicts a sectional side view of an embodiment of a connector configured with a conductive member proximate a second end of a connector body, and a sealing member located proximate a second end of a post, in accordance with the present invention.

With still further continued reference to the drawings, FIG. 9 depicts a sectional side view of an embodiment of a connector 100 configured with a connector body conductive member 80 proximate a second end 54 of a connector body 50, and a sealing member 75 located proximate a second end 44 of post 40. The connector body conductive member 80 should be formed of a conductive material. Such materials may include, but are not limited to conductive polymers, plastics, elastomeric mixtures, composite materials having conductive properties, soft metals, conductive rubber, and/or the like and/or any workable combination thereof. The connector body conductive member 80 may comprise a substantially circinate torus or toroid structure, or other ring-like structure. For example, an embodiment of the connector body conductive member 80 may be an O-ring configured to cooperate with the annular recess 56 proximate the second end 54 of connector body 50 and the cavity 38 extending axially from the edge of second end 34 and partially defined and bounded by an outer internal wall 39 of threaded nut 30 such that the connector body conductive O-ring 80 may make contact with and/or reside contiguous with the annular recess 56 of connector body 50 and outer internal wall 39 of threaded nut 30 when attached to post 40 of connector 100. The connector body conductive member 80 may facilitate an annular seal between the threaded nut 30 and connector body 50 thereby providing a physical barrier to unwanted ingress of moisture and/or other environmental contaminates. Moreover, the connector body conductive member 80 may facilitate electrical coupling of the connector body 50 and threaded nut 30 by extending therebetween an unbroken electrical circuit. In addition, the connector body conductive member 80 may facilitate grounding of the connector 100, and attached coaxial cable (shown in FIG. 1), by extending the electrical connection between the connector body 50 and the threaded nut 30. Furthermore, the connector body conductive member 80 may effectuate a buffer preventing ingress of electromagnetic noise between the threaded nut 30 and the connector body 50. It should be recognized by those skilled in the relevant art that the connector body conductive member 80, like the mating edge conductive member 70, may be manufactured by extruding, coating, molding, injecting, cutting, turning, elastomeric batch processing, vulcanizing, mixing, stamping, casting, and/or the like and/or any combination thereof in order to provide efficient production of the component.

Figure 9A:
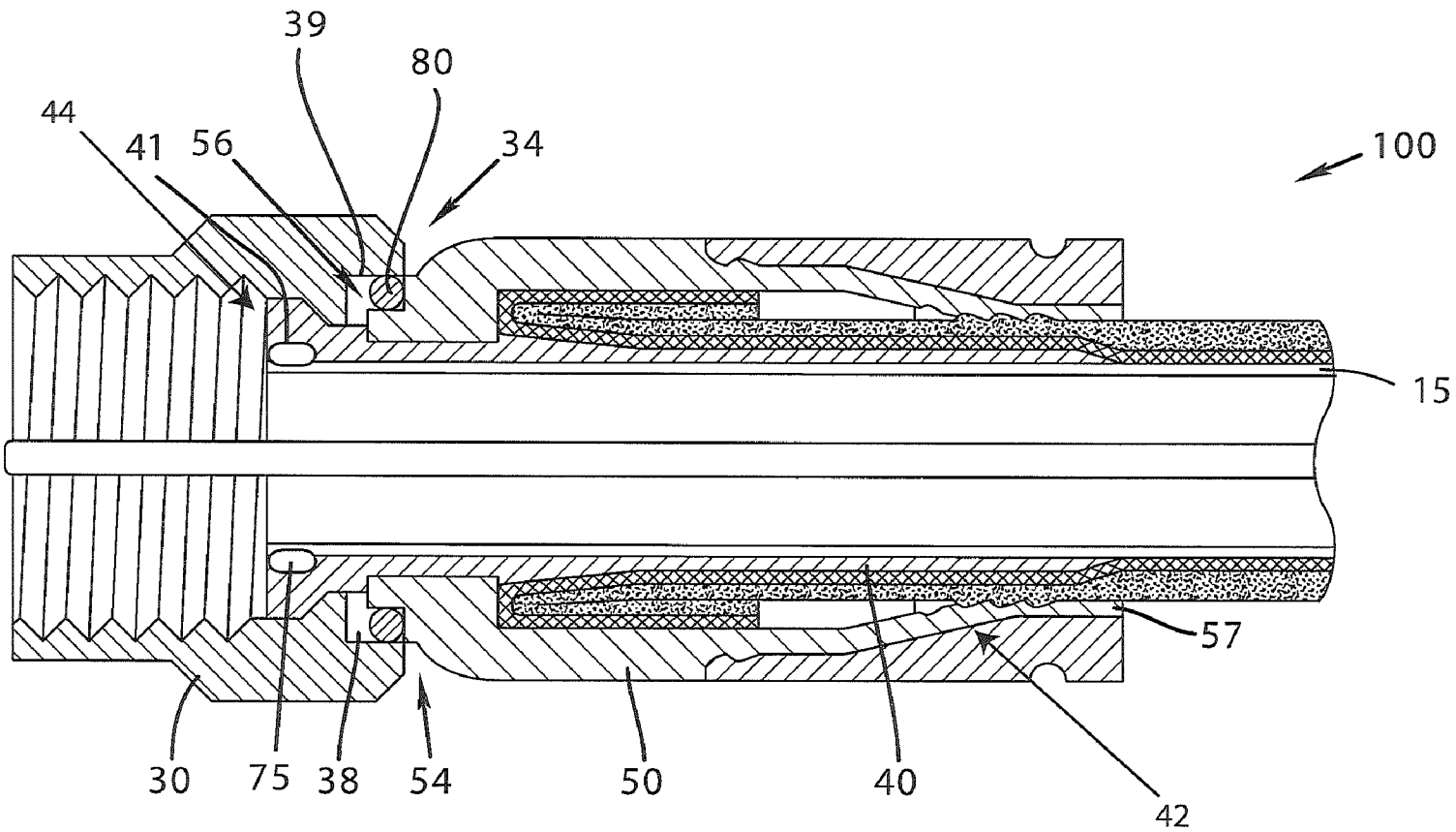
FIG. 9A depicts a sectional side view of an embodiment of a connector configured with a conductive member proximate a second end of a connector body, and a sealing member located proximate a second end of a post having a post notch, in accordance with the present invention.

FIG. 9A depicts a sectional side view of an embodiment of a connector 100 configured with connector body conductive member 80 proximate a second end 44 of a post 40, and a sealing member 75 located proximate a second end 44 of the post 40, wherein a portion of the sealing member 75 resides in a post notch 41, in accordance with the present invention. The post notch 41 may be a notch, opening, indent, recess, detent, trough, or slot that may accommodate a portion of the sealing member 75. The post notch 41 may be curvilinear to accommodate a curvilinear sealing member 75 or the post notch 41 may form 90° angles to accommodate a square or rectangular sealing member 75. The post notch 41 may extend 360° around the inside of the post 40. For example, a portion of the sealing member 75 in the shape of an O-ring may fit within in the post notch 41, while the other portion maintains direct contact with the foil layer 15 providing a barrier against external environmental elements from entering a connector 100. Additionally, there may be multiple post notches 41 corresponding to multiple sealing members 75 as described supra.

With reference to FIGS. 1-2A and 7-9A, the sealing member 75 and either one or both of the mating edge conductive member, or O-ring 70, and connector body conductive member, or O-ring 80, may be utilized in conjunction with an integral post connector body 90. For example, the mating edge conductive member 70 may be inserted within a threaded nut 30 such that it contacts the mating edge 99 of integral post connector body 90 as implemented in an embodiment of connector 100. By further example, the connector body conductive member 80 may be position to cooperate and make contact with the recess 96 of connector body 90 and the outer internal wall 39 (see FIG. 3) of an operably attached threaded nut 30 of an embodiment of a connector 100. Those in the art should recognize that embodiments of the connector 100 may employ all three of the sealing member 75, the mating edge conductive member 70, and the connector body conductive member 80 in a single connector 100 (shown in FIGS. 2-2A). Accordingly the various advantages attributable to each of the sealing member 75, mating edge conductive member 70, and the connector body conductive member 80 may be obtained.

A method for sealing a coaxial cable 10 through a connector 100 is now described with reference to FIG. 1 which depicts a sectional side view of an embodiment of a connector 100. A coaxial cable 10 may be prepared for connector 100 attachment. Preparation of the coaxial cable 10 may involve removing the protective outer jacket 12 and drawing back the conductive grounding shield 14 or shields 14 to expose a portion of a foil layer 15 surrounding the interior dielectric 16. Further preparation of the embodied coaxial cable 10 may include stripping the foil layer 15 and dielectric 16 to expose a portion of the center conductor 18. Various other preparatory configurations of coaxial cable 10 may be employed for use with connector 100 in accordance with standard broadband communications technology and equipment. For example, the coaxial cable 10 may be prepared without drawing back the conductive grounding shield 14 or shields 14, but merely stripping a portion thereof to expose the foil layer 15, the interior dielectric 16, and center conductor 18.

Referring back to FIG. 1, further depiction of a method for sealing a coaxial cable 10 through a connector 100 is described. A connector 100 including a post 40 having a first end 42 and second end 44 may be provided. Moreover, the provided connector may include a connector body 50 and a sealing member 75 located proximate the second end 44 of post 40. The proximate location of the sealing member 75 should be such that the sealing member 75 makes physical contact with post 40. The sealing member 75 may also make contact with the foil layer 15 and an interface port 20 when the connector 100 is advanced onto the interface port 20. In one embodiment, the sealing member 75 may be press-fit, attached, adhered, placed, positioned, etc. on an inner surface of the post 40 proximate the second 44 to establish and maintain the physical contact. For example, the sealing member 75 may be press-fit, attached, adhered, placed, positioned, etc. along the inside or inside of the post 40. In another embodiment, the sealing member 75 may be positioned, located, placed, etc. in a post notch 41, wherein a portion, or first surface, of the sealing member 75 resides in the post notch 41, and the other portion, or second surface, of the sealing member 75 maintains physical contact with the post 40.

A non-exhaustive description of one embodiment of a method of sealing a coaxial cable 10 is further described. The steps may include providing a connector 100 for coupling an end of a coaxial cable 10, the coaxial cable 10 having a center conductor 18 surrounded by a dielectric 16, the dielectric 16 being surrounded by a foil layer 15, the foil layer 15 being surrounded by a conductive grounding shield 14 or shields 14, the conductive grounding shield 14 being surrounded by a protective outer jacket 12; placing, locating, inserting, attaching, affixing, positioning, adhering, etc., a sealing member 75 between the foil layer 15 and the post 40 proximate the second end 44 of the post 40; and forming, creating, erecting, etc, a barrier against external environmental elements from entering the connector 100 by preventing the environmental elements from bypassing a seal created by the sealing member 75, the sealing member 75 effectively blocking the flow of an environmental element into the connector 100.

The steps may further include the steps of coupling the surfaces of the sealing member 75, foil layer 15, the post 40, and the interface port 20; extending, enlarging, expanding, locating, placing, positioning, etc. the sealing member 75 a lateral distance away from the post 40, wherein a first portion of the sealing member continuously contacts the post 40 or post notch 41 and a second portion of the sealing member 75 contacts the mating surface of an interface port 20; allowing unimpeded movement of the dielectric through the post; and radially compressing the outer surface 57 of connector body 50 against the coaxial cable 10 thereby affixing the cable into position and sealing the connection. Furthermore, radial compression of a resilient member placed within the connector 100 may attach and/or the coaxial cable 10 to connector 100. In addition, the radial compression of the connector body 50 may be effectuated by physical deformation caused by a fastener member 60 that may compress and lock the connector body 50 into place. Moreover, where the connector body 50 is formed of materials having and elastic limit, compression may be accomplished by crimping tools, or other like means that may be implemented to permanently deform the connector body 50 into a securely affixed position around the coaxial cable 10.

Additionally, another embodiment of a method of sealing a coaxial cable 10 may include providing a connector body 50 and a mating edge conductive member 70 located proximate the second end 44 of post 40. The proximate location of the mating edge conductive member 70 should be such that the mating edge conductive member 70 makes physical and electrical contact with post 40. In one embodiment, the mating edge conductive member or O-ring 70 may be inserted into a threaded nut 30 until it abuts the mating edge 49 of post 40. However, other embodiments of connector 100 may locate the mating edge conductive member 70 at or very near the second end 44 of post 40 without insertion of the mating edge conductive member 70 into a threaded nut 30. Furthermore, the method of sealing a coaxial cable 10 may include a connector body 50, a threaded nut 30, and a connector body conductive member or seal 80. The connector body conductive member or seal 80 may be configured and located such that the connector body conductive member 80 electrically couples and physically seals the connector body 50 and threaded nut 30. In one embodiment, the connector body conductive member or seal 80 may be located proximate a second end 54 of a connector body 50. The connector body conductive member 80 may reside within a cavity 38 of threaded nut 30 such that the connector body conductive member 80 lies between the connector body 50 and threaded nut 30 when attached. Furthermore, the particularly embodied connector body conductive member 80 may physically contact and make a seal with outer internal wall 39 of threaded nut 30 and/or front leading step at the junction of wall 39 and through hole 36 (shown in FIG. 3). Moreover, the connector body conductive member 80 may physically contact and seal against the surface of connector body 50. Accordingly, where the connector body 50 is comprised of conductive material and the threaded nut 30 is comprised of conductive material, the connector body conductive member 80 may electrically couple the connector body 50 and the threaded nut 30.

As an additional step, sealing of the coaxial cable 10 through the connector 100 may be accomplished by advancing the connector 100 onto an interface port 20 until a surface of the interface port mates with a surface of the sealing member 75. Because the sealing member 75 is located such that it makes physical contact with post 40 and the foil layer 15, a seal or barrier may be formed, and when a mating surface of the mated interface port 20 contacts a surface or portion of the sealing member 75, a seal or barrier, or a part of the seal/barrier may be formed and/or strengthened, thereby preventing external environmental elements from entering a connector 100 or coaxial cable 10. Accordingly, the interface port 20 can make physical contact with the surface or a portion of the sealing member 75; therefore, the interaction, contact and/or coupling with the sealing member 75 may form a barrier against moisture and other external environmental elements when physically pressed against the interface port 20. Advancement of the connector 100 onto the interface port 20 may involve the threading on of attached threaded nut 30 of connector 100 until a surface of the interface port 20 abuts the surface of the sealing member 75 and axial progression of the advancing connector 100 is hindered by the abutment. In an alternative embodiment, advancement of the connector 100 onto the interface port 20 may involve the threading on of attached threaded nut 30 of connector 100 until a surface of the interface port 20 abuts the surface of the mating edge conductive member 70 and axial progression of the advancing connector 100 is hindered by the abutment. However, it should be recognized that embodiments of the connector 100 may be advanced onto an interface port 20 without threading and involvement of a threaded nut 30.

Figure 10:
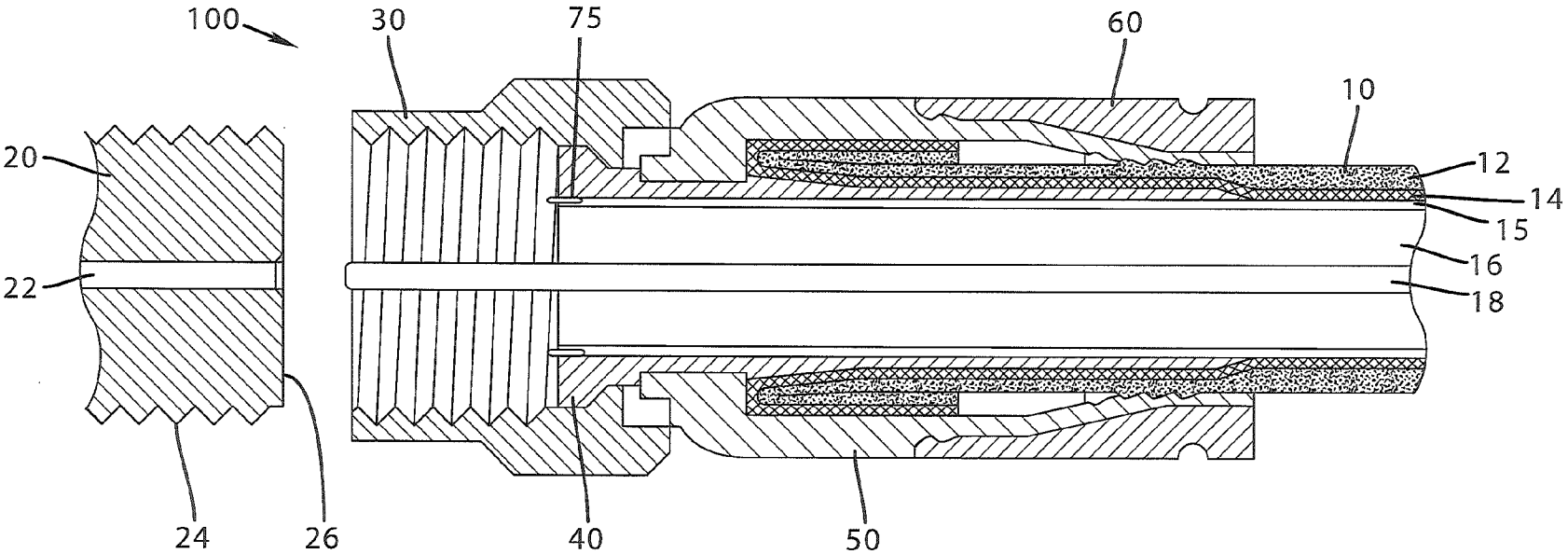
FIG. 10 depicts a sectional side view of an embodiment of a connector configured with a sealing member located proximate the second end of a post, the sealing member extending a distance from the post, in accordance with the present invention.
Figure 10A:
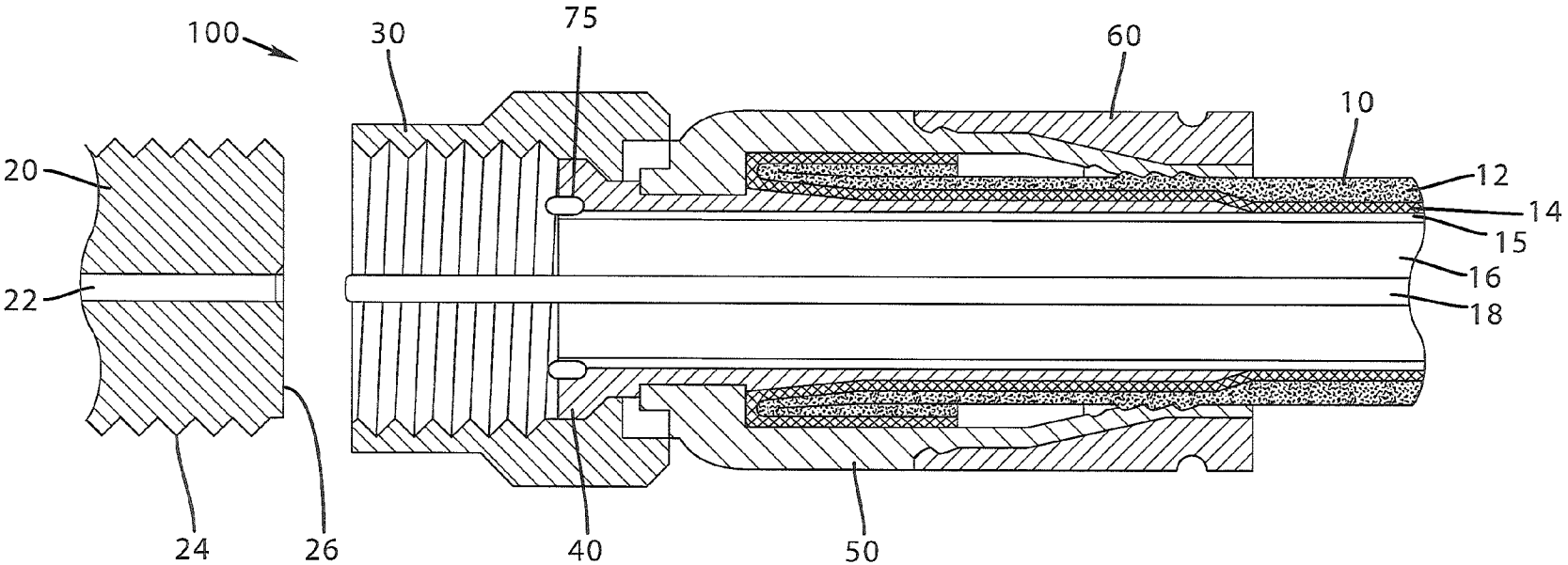
FIG. 10A depicts a sectional side view of an embodiment of a connector configured with a sealing member located proximate a second end of a post having a post notch, the sealing member extending a distance from the post, in accordance with the present invention.

In one embodiment, the sealing member 75 may be flush with the mating edge 49 of the post 40, such that the interface port 20 physically contacts the mating edge 49, thereby establishing and maintaining physical contact with the sealing member 75 located therebetween. In another embodiment, the sealing member 75 may extend a lateral distance from or outward from the mating edge 49, such that a surface of the interface port 20 need not physically contact the mating edge 49, yet may still establish and maintain physical contact with the sealing member 75 (shown in FIGS. 10-10A). In yet another embodiment, the sealing member 75 may extend a lateral distance from or outward from the mating edge 49, proximate the second end 44 of the post 40, and when the surface of the interface port 20 physically contacts the mating edge 49, the sealing member 75 may conform, compress, flatten out, deform. The force applied by the mating surface of the interface port 20 against the sealing member 75 may enhance, strengthen, form a part of the seal or barrier against external environmental elements.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising:

a connector body attached to a post, wherein the post has a first end and a second end, the first end configured to be inserted into an end of the coaxial cable around the foil layer encompassing the dielectric and under the conductive grounding shield thereof;

a port coupling element attached to the post; and an elastomeric sealing member positioned along an inner surface of the post forming a barrier against environmental elements.

2. The connector of claim 1, wherein the connector body includes a first end and a second end, the first end configured to deformably compress against and seal a received coaxial cable.

3. The connector of claim 1, wherein the sealing member is resilient.

4. The connector of claim 1, wherein the sealing member is a rubber-like polymer.

5. The connector of claim 1, wherein a conductive seal is located proximate the second end of the connector body, and further wherein the conductive seal is configured to provide a shield for preventing ingress of electromagnetic noise into the connector.

6. The connector of claim 1, wherein the post has a notch proximate the second end, the notch accommodating a first surface of the sealing member, while a second surface of the sealing member maintains contact with the foil layer.

7. The connector of claim 1, further comprising:

a conductive mating member, located proximate the second end of the post, wherein the conductive member facilitates grounding of the coaxial cable; and wherein the conductive mating member forms a shield preventing ingress of electromagnetic noise into the connector.

8. The connector of claim 1, wherein the sealing member extends a distance from the second end of the post.

9. A connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising:

a connector body attached to a post wherein the post has a first end and a second end, the first end configured to be inserted into an end of the coaxial cable around the foil layer encompassing the dielectric and under the conductive grounding shield thereof;

a port coupling element rotatably attached to the post; and an elastomeric sealing member positioned between the foil layer and the post, wherein the sealing member prevents environmental elements from entering the connector.

10. The connector of claim 9, wherein the sealing member extends a lateral distance from an edge of the second end of the post, wherein an interface port deformably compresses the sealing member when the connector is mated to the interface port.

11. The connector of claim 9, wherein the connector body includes a first end and a second end, the first end configured to deformably compress against and seal a received coaxial cable.

12. The connector of claim 9, wherein a conductive seal is located proximate the second end of the connector body, and further wherein the seal is configured to provide a shield for preventing ingress of electromagnetic noise into the connector.

13. The connector of claim 9, wherein the post has a notch proximate the second end of the post, the notch accommodating a first surface of the sealing member, while a second surface of the sealing member maintains contact with the foil layer.

14. The connector of claim 9, further comprising:

a conductive mating member, located proximate the second end of the post, wherein the conductive member facilitates grounding of the coaxial cable; and wherein the conductive mating member helps complete a shield preventing ingress of electromagnetic noise into the connector.

15. A connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising:

a connector body, having a first end and a second end, the first end configured to deformably compress against and seal a received coaxial cable;

a post, attached to the connector body;

a port coupling element, attached to the post;

an elastomeric sealing member located so as to prevent entry of external environmental elements between the post and the foil layer surrounding the dielectric; and a plurality of conductive members, the plurality of conductive members completing a shield preventing ingress of electromagnetic noise into the connector and facilitating grounding of the coaxial cable.

16. The connector of claim 15, wherein the plurality of conductive members comprise a first conductive member, and a second conductive member.

17. The connector of claim 15, wherein the first conductive member is a conductive sealing member located proximate the second end of the connector body for electrically coupling and physically sealing the connector body and the threaded nut.

18. The connector of claim 15, wherein the second conductive member is a conductive mating member located proximate the second end of the post and facilitates an annular seal between the threaded nut and the post thereby electrical coupling the post and the coupling element by extending therebetween an unbroken electrical circuit.

19. The connector of claim 15, wherein the post includes a first end and a second end, the first end configured to be inserted into an end of the coaxial cable around the foil layer encompassing the dielectric and under the conductive grounding shield thereof.

20. A connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising:

a connector body having a first end and a second end, the first end configured to deformably compress against and seal a received coaxial cable, wherein a post is attached to the connector body;

a rotatable coupling element attached to the post, wherein the post has a first end and a second end; and elastomeric means for sealing the dielectric against ingress of environmental elements without impeding advancing movement of the dielectric and the foil layer through post of the connector.

21. A method for sealing a coaxial cable connector, the method comprising:

fixedly attaching a coaxial cable to the coaxial cable connector, the coaxial cable having a center conductor surrounded by a dielectric, the dielectric being surrounded by a foil layer, the foil layer being surrounded by a conductive grounding shield, the conductive grounding shield being surrounded by a protective outer jacket;

positioning an elastomeric sealing member of the coaxial cable connector on a radially inward surface of a post of the connector to block ingress of an environmental element into the connector; and advancing the connector onto an interface port until a surface of the interface port mates with a surface of the sealing member to form part of a seal.

22. The method of claim 21, wherein the connector further includes a threaded nut, and a conductive member electrically coupling and physically sealing the connector body and threaded nut.

23. The method of claim 21, wherein a conductive mating member is located proximate the second end of the post.

24. The method of claim 21, wherein a first portion of the sealing member rests in a post notch, and a second portion of the sealing member continuously contacts the foil layer.

25. A method for sealing a coaxial cable connector that is attachable to a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the method comprising:

forming a barrier against ingress of an environmental element, the barrier formed by an elastomeric sealing member of the coaxial cable connector that is positioned along an inner surface of a post of the connector, wherein the sealing member establishes and maintains physical communication between the inner surface of the post of the connector and the foil layer surrounding the dielectric of the cable, when the cable is attached to the connector.

26. The method of claim 25, further comprising:

allowing unimpeded movement of the dielectric and surrounding foil layer through the post, during attachment of the cable to the connector.

27. The method of claim 25, wherein a first portion of the sealing member extends a lateral distance away from the second end of the post.

28. The method of claim 27, further comprising:

advancing the coaxial cable connector onto an interface port until a surface of the sealing member abuts the mating surface of the interface port, so that the sealing member continuously contacts and seals against the mating surface of the interface port, while also being sealed against a surface of the foil layer of the cable and a surface of the post.

29. The method of claim 25, wherein a first portion of the sealing member rests in a post notch, and a second portion of the sealing member continuously contacts the foil layer surrounding the dielectric of the coaxial cable.

* * * * *